US007063123B2

(12) United States Patent
Lethers

(10) Patent No.: US 7,063,123 B2
(45) **Date of Patent: *Jun. 20, 2006**

(54) ADJUSTABLE PET DOOR

(75) Inventor: E. Alan Lethers, San Luis Obispo, CA (US)

(73) Assignee: Patio Pacific, Inc., San Luis Obispo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/781,267

(22) Filed: Feb. 17, 2004

(65) Prior Publication Data

US 2004/0163346 A1 Aug. 26, 2004

Related U.S. Application Data

(63) Continuation of application No. 10/177,920, filed on Jun. 21, 2002, now Pat. No. 6,691,483.

(51) Int. Cl.
*E06B 7/28* (2006.01)

(52) U.S. Cl. ..... 160/180; 49/169; 52/455

(58) Field of Classification Search ..... 160/116, 160/180; 52/455, 457, 473; 49/169, 505, 49/171

See application file for complete search history.

(56) References Cited

U.S. PATENT DOCUMENTS

| | | | | |
|---|---|---|---|---|
| 3,932,959 | A * | 1/1976 | Jansons et al. | 49/74.1 |
| 4,047,331 | A * | 9/1977 | Davlantes | 49/171 |
| 6,272,793 | B1 * | 8/2001 | Davlantes | 49/168 |
| 6,691,483 | B1 * | 2/2004 | Lethers | 52/455 |

* cited by examiner

*Primary Examiner*—Blair M. Johnson
(74) *Attorney, Agent, or Firm*—Thomas F. Lebens; Sinsheimer, Schiebelhut & Baggett

(57) ABSTRACT

A panel pet door is an insert into a sliding glass door and has a panel door frame and a movable door flap assembly mounted on the panel door frame. The door flap assembly can slide vertically on the panel door frame along tracks in the vertical stiles of the panel door frame. A plurality of riser spacer panels are also mounted on the panel door frame and are also vertically slidable on the frame via the vertical tracks. The door flap assembly and spacers are selectively removable and replaceable to effect a change in the rise of the door flap assembly and the height of the door flap assembly.

21 Claims, 10 Drawing Sheets

ADJUSTABLE PET DOOR

CROSS REFERENCE TO RELATED APPLICATIONS

This application is a continuation of U.S. patent application Ser. No. 10/177,920 of Lethers, filed Jun. 21, 2002, now U.S. Pat. No. 6,691,483 according to 35 USC §120 and is herein incorporated by reference.

BACKGROUND OF THE INVENTION

The present invention relates generally to panel doors, and more particularly to panel pet doors for insertion into sliding glass doors.

Panel pet doors for sliding glass doors are pet doors designed to fit in the space that results when a sliding glass door is partially opened (or, also, the resulting space when a stationary panel is moved to one side). The advantage to this type of pet door is that it does not require cutting a hole through, and thereby ruining, a door.

There are three dimensions that are critical to accommodating the animal(s) that will be using a panel pet door: width of a flap opening, height of the flap opening and, just as important, rise. The rise is defined as the height of a bottom edge of the flap above a base of the panel door. For a most comfortable fit, the top edge of the flap should be about the same height as the pet at the top of the withers (top of the shoulder). Customarily, panel pet door flaps have not been designed to be that height. Rather, the flap is raised up off the ground (the rise) so as to get the flap opening about even with the trunk of the pet's body. Short dogs would prefer a shorter rise and taller dogs need a higher rise. For example, currently a pet door company manufactures a "large" pet door with a flap that measures 10×15 inches with a 5 inch rise. They also offer a "large/tall" pet door using the same flap, but with a 9 inch rise.

It would be beneficial to a consumer to offer the largest sizes in at least three or four different rises and for medium and small/medium sizes to be offered in at least two rises. It would also be beneficial to offer customers ways to change the size of the flap door and/or rise, such as when a dog changes size over time, e.g., grows from a puppy into a mature dog. Heretofore, the only way a manufacturer could offer multiple rise options was by building and maintaining an inventory of separate panel pet door sizes for each rise option.

It would also be beneficial to offer customers ways to change the size of the flap door in addition to adjusting the height of the rise, all without replacing the entire panel pet door. Common circumstances which would make this desirable occur when, for example, the owner of a taller dog acquires a short dog (desiring to preserve the height of the present flap, but shorten the rise.), or vice versa. Also, if an owner's dog becomes injured the dog may benefit from a lower rise and/or a taller flap.

There is thus a need in the art for a panel pet door that provides a way to offer customers different height and rise combinations of the pet door flap without having to manufacture a separate panel pet door for each combination, and provides a way for customers to adjust the rise and height of the pet door flap without having to replace an entire panel pet door.

SUMMARY OF THE INVENTION

The present invention advantageously addresses the needs above as well as other needs by providing a panel door and method of adjusting the panel door.

In one embodiment, the invention can be characterized as a panel door assembly comprising a panel door frame, an entrance portal assembly mounted on the panel door frame that is vertically slidable on the panel door frame and a spacer panel mounted on the panel door frame that is vertically slidable on the frame.

In another embodiment, the invention can be characterized as a the panel door assembly described above further comprising at least one additional spacer panel mounted on the panel door frame that is vertically slidable on the panel door frame, a total number of spacer panels mounted on the panel door frame comprising a plurality of vertically slidable spacer panels.

In another embodiment, the invention can be characterized as a method of adjusting an entrance of a panel door assembly comprising the steps of sliding vertically at least one spacer panel and an entrance portal assembly out of a panel door frame of the panel door assembly and sliding vertically at least one spacer panel and the entrance portal assembly into the panel door frame in a configuration such that the entrance portal is at a different height from a bottom of the panel door frame.

In another embodiment, the invention can be characterized as a method of adjusting an entrance of a panel door assembly comprising the steps of sliding vertically at least one spacer panel and a first entrance portal assembly out of a panel door frame of the panel door assembly and sliding vertically a second entrance portal assembly of a different height than the first into the panel door frame.

In yet another embodiment, the invention can be characterized as a method of adjusting an entrance of a panel door assembly comprising the steps of sliding vertically a first entrance portal assembly out of a panel door frame of the panel door assembly and sliding vertically a second entrance portal assembly of a different height than the first and at least one spacer panel into the panel door frame.

A better understanding of the features and advantages of the present invention will be obtained by reference to the following detailed description of the invention and accompanying drawings which set forth an illustrative embodiment in which the principles of the invention are utilized.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE PREFERRED EMBODIMENTS

The following description of the presently contemplated best mode of practicing the invention is not to be taken in a limiting sense, but is made merely for the purpose of describing the general principles of the invention. The scope of the invention should be determined with reference to the claims.

Figures 1, 2, 3:
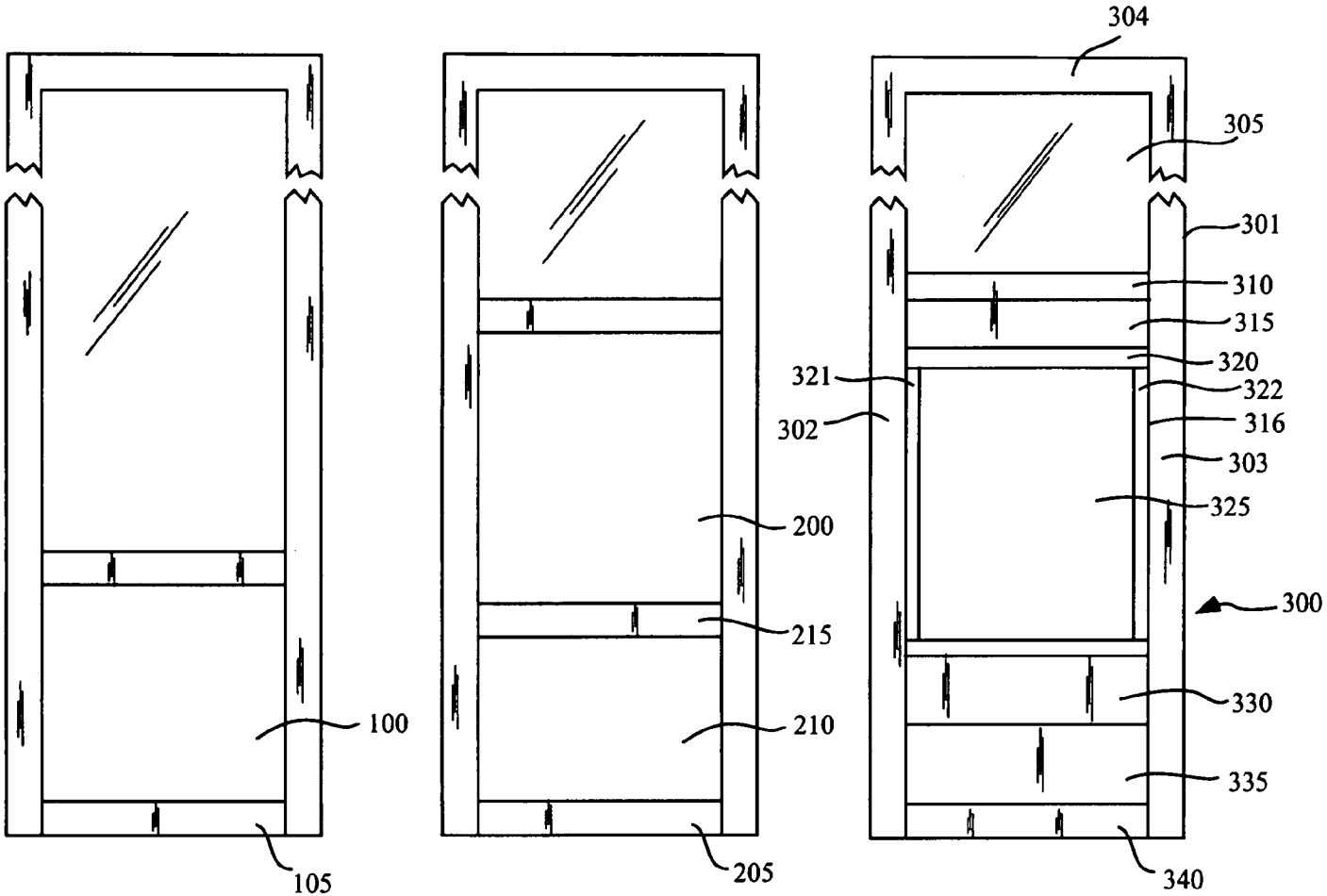
Fig. 2 (Prior Art)
Fig. 1 (Prior Art)
FIG. 1 is a front elevation view of a fixed rise/height panel pet door.
FIG. 2 is a front elevation view of another fixed rise/height panel pet door.
FIG. 3 is a front elevation view of a panel pet door according to an embodiment of the present invention.

Referring to FIGS. 1 and 2, shown are front elevation views of examples of panel pet doors with fixed, i.e., single, rise and height dimensions. In FIG. 1, a fixed door flap 100 has a rise equal to the height of a cross member 105. To make the rise higher, a separate panel door (FIG. 2) is built with the door flap 200 raised higher and a first additional fixed cross piece 210 attached permanently below a second additional cross piece 215 below the door flap 200 and above cross member 205. One difficulty with this approach is that it results in a great many stocking units (SKU's), i.e., a great deal of panel pet door inventory, and an increase in raw materials inventory to support manufacturing. Also, production efficiency is decreased as there are many small production runs for each of a large number of rise options for each flap size. For example, in the event a panel pet door is available in four standard height adjustment ranges, three frame colors and, counting each size/rise combination as separate, 16 size/rise combinations, a total of 192 SKU's are required, i.e., a total of 192 different panel pet door models must be maintained in inventory.

Figure 4:
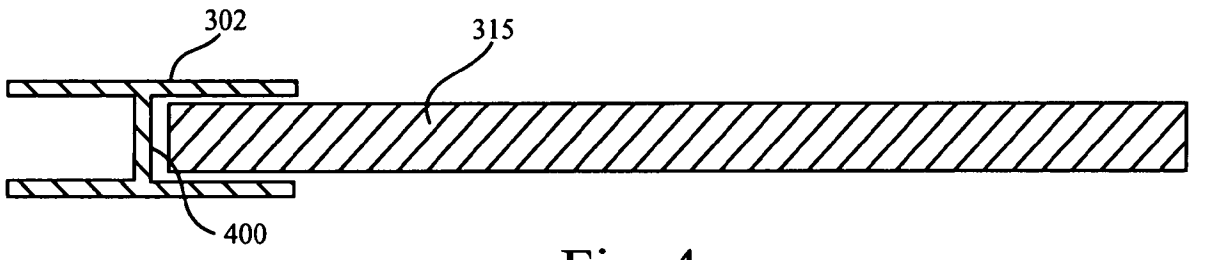
FIG. 4 is a partial top cross sectional view of the panel pet door of FIG. 3.

Referring to FIGS. 3 and 4, shown in FIG. 3 is a front elevation view of a panel pet door 300 according to an embodiment of the present invention and in FIG. 4 shown is a partial top cross sectional view of the panel pet door of FIG. 3. Shown in FIG. 3 are the panel door frame 301 having two vertical stiles 302, 303, and a top horizontal frame cross piece 304. Also shown are a glass pane 305, a top fixed cross piece 310 a movable top spacer panel 315, a movable entrance portal assembly 316 (having a movable frame 320 and a door flap 325), two movable riser spacer panels 330, 335, and a bottom fixed cross piece 340. In FIG. 4 shown is the movable top spacer panel 315 and stile 302 of FIG. 3 along with a vertical track 400 in the stile 302.

The panel door frame 301 is a solid frame of wood, metal, plastic or vinyl (preferably metal). The two stiles 302, 303 are fixedly attached to the top horizontal frame cross piece 304 and may be formed integral with the two vertical stiles 302, 303. A pane 305 (preferably of glass) is attached in the interior of the top portion of the frame 301 above the top fixed cross piece 310 that extends horizontally between the two stiles 302, 303.

Directly below the top fixed cross piece 310 is the movable top spacer panel 315. This panel 315 fits into and is movable vertically along a vertical track 400 in each stile 302, 303 (shown in FIG. 4) located on the interior of the two stiles 302, 303. The top spacer panel 315 is located above and rests on the movable entrance portal assembly 316 (preferably a movable door flap assembly 316). The movable door flap assembly 315 is also movable along vertical tracks 400 (shown in FIG. 4) located on the interior of the two stiles 302, 303.

The door flap assembly 316 has a movable frame 320 that fits into the tracks 400 of the stiles 302, 303 (shown in FIG. 4) like the movable top spacer panel 315. Preferably, two vertical frame members 321, 322 of the movable frame 320 fit into the tracks 400 of the stiles 302, 303 (as in FIG. 4). The door flap 325 is preferably flexible and is hingedly attached to the movable frame 320 to allow the passage of pets through the flap 325.

Located below the door flap assembly 316 in the panel door frame 301 are two movable riser spacer panels 330, 335 that are also movable along the tracks 400 of the two stiles 302, 303 (shown in FIG. 4). Located below the two riser spacer panels is the bottom fixed cross piece 340. The bottom fixed cross piece is fixedly attached between the bottom of the two stiles 302, 303, and is preferably removable and thus not formed integral with the panel door frame 303.

The spacer panels 315, 330, 335 and the door flap assembly 316 can be slid out of the panel door frame 301 through an opening in the bottom of the frame 301 by removal of the bottom fixed cross piece 340 from the panel door frame 301. This is to allow removal and replacement of the spacer panels 315, 330, 335 and the door flap assembly 316. Replacement of the spacer panels 315, 330, 335 into the panel door frame 301 in a different configuration and/or with spacer panels of a different size effects a change in the rise (the distance between the bottom of the door flap 325 and bottom of the panel door 300). For example, to increase the rise to a degree equal to the height of the top spacer panel 315, first remove the bottom cross piece 340 and then remove spacer panels 315, 330, 335 and the door flap assembly 316 by sliding them out through the bottom of the panel door frame 301. Next, slide in the door flap assembly 316 into the panel door frame and then slide the same spacer panels 315, 330, 335 below the door flap assembly 316 into the panel door frame 301. Finally, replace the bottom fixed cross piece by reattaching it between the bottom of the two stiles 302, 303. Now all the spacer panels 315, 330, 335 are located below the door flap assembly 316, thus increasing the rise of the door flap 325.

A removable bottom crosspiece 340 may be attached to the stiles 302, 303 by reusable means such as screws or a locking mechanism (preferably screws). Also, replacement of the spacer panels 315, 330, 335 with a spacer panel (or panels) of a different height or heights can also effect a change in the rise. The height of the door flap assembly 316 in the panel door 300 may also be changed by sliding out the door flap assembly 316 in the manner previously described and replacing it with a door flap assembly of a different height. Optionally, this may be done in combination with changing the rise as described above.

It is important to note that the area between the top fixed cross piece 310 and the bottom fixed cross piece 340 may be filled with a door flap assembly 316 of any selected height and any combination of spacer panels of various optional heights, either above or below the door flap assembly 316.

Figure 5:
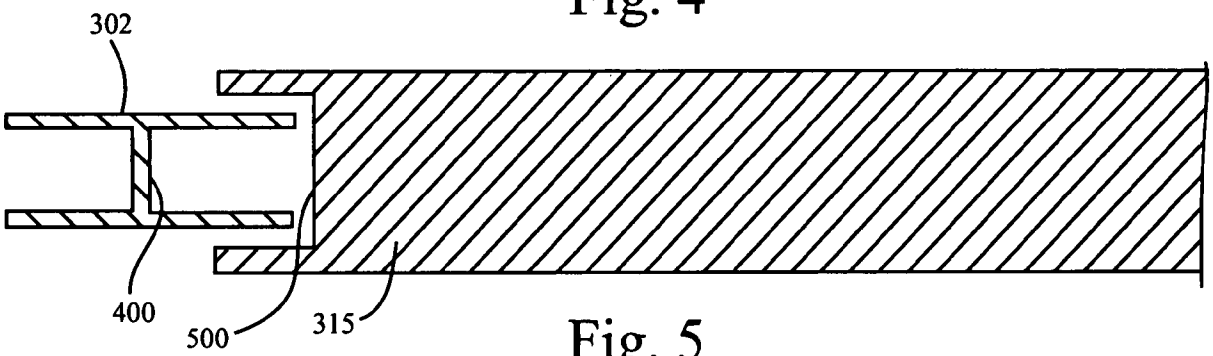
FIG. 5 is a partial top cross sectional view of an alternative embodiment of the panel pet door of FIG. 3.

Referring next to FIG. 5, shown is a partial top cross sectional view of an alternative embodiment of the panel pet door of FIG. 3. Shown is the stile 302 of FIG. 4 having a vertical track 400 and an alternative embodiment of the movable top spacer panel 315 having a vertical track 500 in the spacer 315.

The vertical track 500 is located on each side of the spacer 315 (one side shown in FIG. 5) and is representative of an alternative way for spacers and door flap assemblies to fit in the panel door frame 301. The track 500 is slightly wider than the depth of the stile 302 such that the stile 302 fits into the vertical track 500 and allows the spacer 315 to slide vertically along the stile 302.

Figure 6:
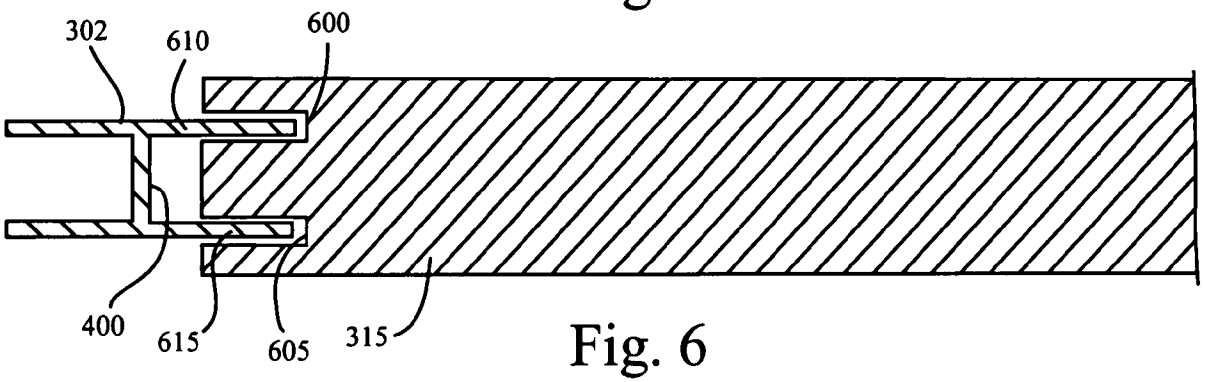
FIG. 6 is a partial top cross sectional view of a further alternative embodiment of the panel pet door of FIG. 3.

Referring next to FIG. 6, shown is a partial top cross sectional view of an alternative embodiment of the panel pet door of FIG. 3. Shown is the stile 302 of FIG. 4 having a vertical track 400 and an alternative embodiment of the movable top spacer panel 315 having a vertical tracks 610, 615 in the spacer 315.

The vertical tracks 600, 605 are located on each side of the spacer 315 (one side shown in FIG. 6) and is representative of an alternative way for spacers and door flap assemblies to fit in the panel door frame 301. The tracks 600, 605 are slightly wider than the depth of walls 610, 615 of the track 400 in the stile 302. Thus, the track walls 610, 615 fit respectively into the vertical tracks 600, 605 of the spacer 315 and allow the spacer 315 to slide vertically along the stile 302.

Figure 7:
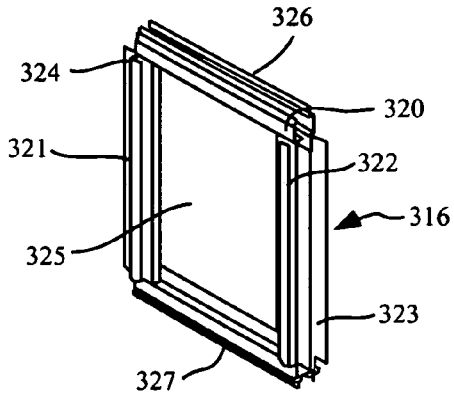
FIG. 7 is a front perspective view of the entrance portal assembly according the embodiment of the present invention shown in FIG. 3.

Referring next to FIG. 7, shown is a front perspective view of the entrance portal assembly 316 (a door flap assembly in this case) according to the embodiment of the present invention shown in FIG. 3. Shown are the door flap frame 320, the two vertical frame members 321, 322 of the door flap frame 320 and the door flap 325.

The door flap assembly frame 320 has guides 323, 324 on the exterior of the vertical frame members that fit into the vertical stiles 302, 303 (shown in FIG. 3) of the panel door frame 302 that allow the door flap assembly 316 to slide vertically along the panel door frame 301 as a single unit. Located on the top and bottom of the door flap frame are projections 326, 327 that allow the door flap assembly 316 to nest into the bottom and top of spacer panels 315, 330, respectively (shown in FIG. 3).

Figure 8:
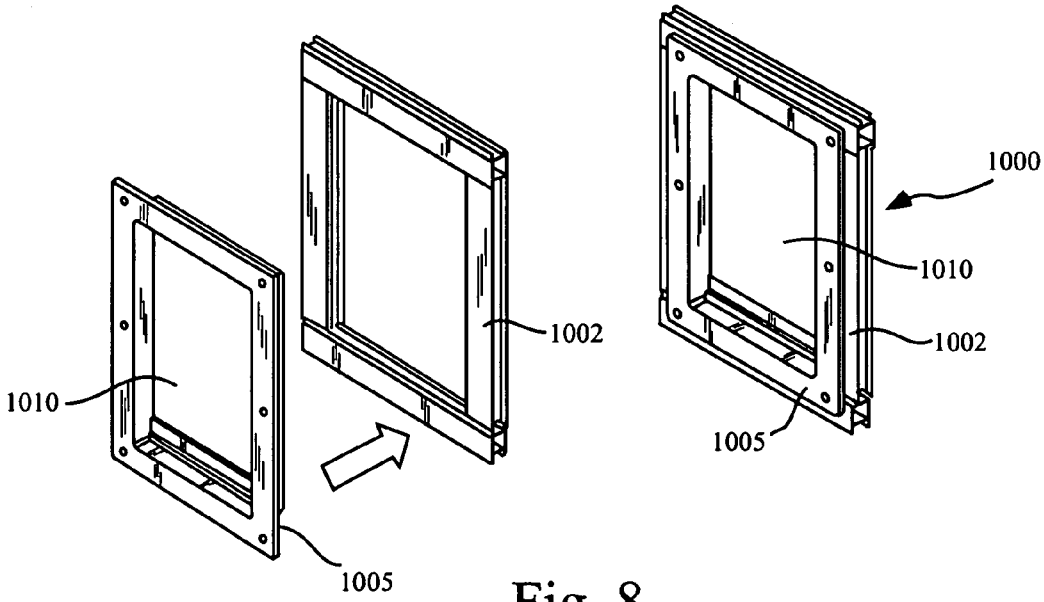
FIG. 8 is a front perspective view of a stepwise assembly of an alternative embodiment of an entrance portal assembly according to the present invention.

Referring next to FIG. 8, shown is a front perspective view of a stepwise assembly of an alternative embodiment of an entrance portal assembly 1000 according to the present invention. Shown is a door flap frame 1002 and a standard (wall or door mounted) pet door 1005 with a flap 1010. The flap frame 1002 is a carrier onto which the pet door 1005 is mounted. The perimeter of the completed door flap assembly 1000 fits into the panel door frame 301 and spacer panels 315, 330 (shown in FIG. 3) in the same manner as the door flap assembly 316 of FIG. 7

Figure 9:
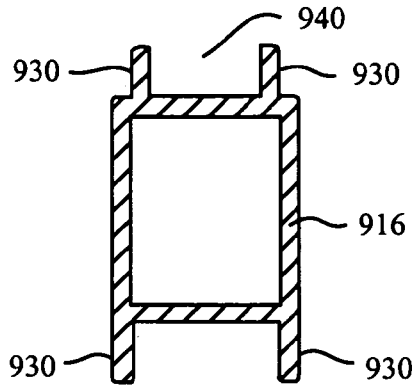
FIG. 9 is a side cross sectional view of a spacer panel according to an embodiment of the present invention.
Figure 10:
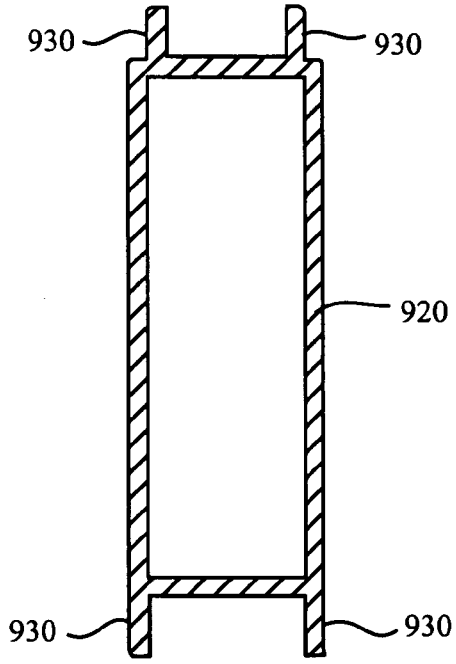
FIG. 10 is a side cross sectional view of taller spacer panel than that of FIG. 9 according to an embodiment of the present invention.
Figure 11:
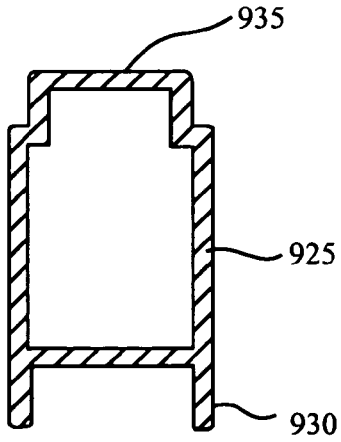
FIG. 11 is a side cross sectional view of an alternative embodiment of a spacer panel according to the present invention.

Referring next to FIGS. 9, 10 and 11, shown are side cross sectional views of a spacer panel, a taller spacer panel and an alternative embodiment of a spacer panel according to the present invention, respectively.

FIGS. 9 and 10 show spacer panels 916, 920 having vertical protrusions 930 at the top and bottom of the panels 916, 920 that allow nesting of the panels 916, 920. The protrusions 930 at the bottom of the panels 916, 920 fit over the protrusions 930 at the top of the panels below them. The protrusions 930 are sufficiently long to allow clearance 940 for screw heads, other fastening means, and weather stripping to fit between the panels 916, 920. The spacer 920 of FIG. 10 is taller to replace two or more "single size" spacers. The spacer 925 of FIG. 11 has a protrusion 935 on top of the spacer with a cross member to shed water more efficiently, but leaves no gap for screw heads.

Figure 12:
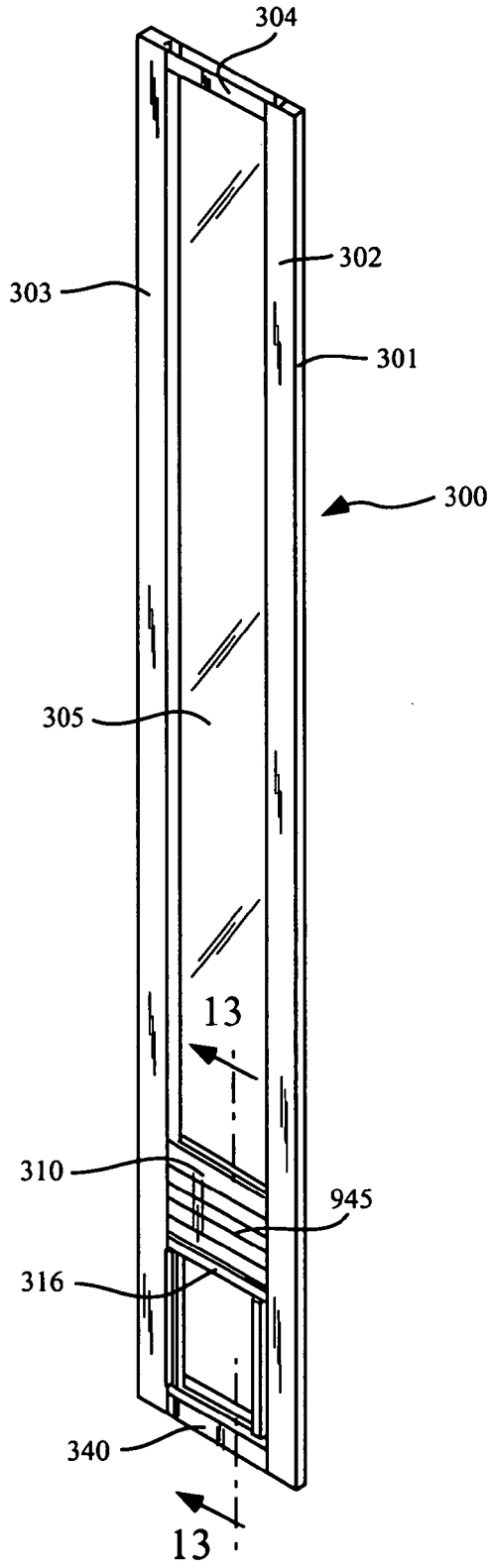
FIG. 12 is a front perspective view of the panel pet door of FIG. 3 according to the present invention, using a different number, size and configuration of spacer panels.

Referring next to FIG. 12, shown is a front perspective view of the panel pet door 300 of FIG. 3 according to the present invention, using a different number, size and configuration of spacer panels.

Shown in FIG. 12 is the panel door frame 301 having two vertical stiles 302, 303, and a top horizontal frame cross piece 304. Also shown are a glass pane 305, a top fixed cross piece 310 nested movable spacer panels 945, a movable entrance portal assembly 316, and a bottom fixed cross piece 340. Note in FIG. 12 that in this configuration the spacer panels 945 are all above the entrance portal assembly 316, thus lowering the rise of the entrance portal assembly.

Figure 13:
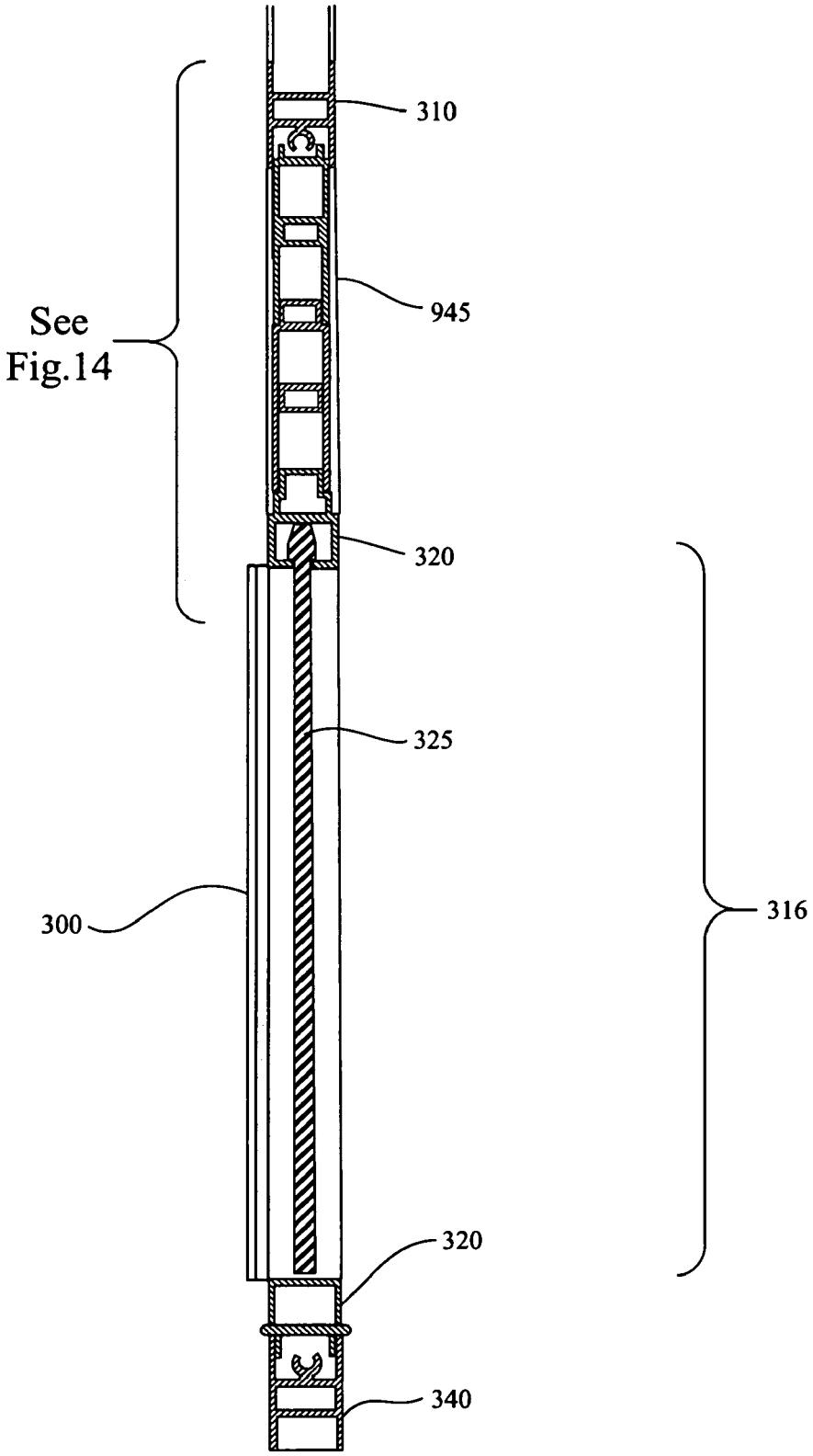
FIG. 13 is a partial side cross sectional view of the panel pet door of FIG. 12.

Referring next to FIG. 13, shown is a partial side cross sectional view of the panel pet door 300 of FIG. 12. Shown in FIG. 13 is the top fixed cross piece 310 nested movable spacer panels 945, the movable entrance portal assembly 316 (showing the door flap assembly frame 320 and flap 325), and a bottom fixed cross piece 340.

Note how the spacers 945 nest together, one on top of the other, and also into the bottom of the top fixed cross piece 310. Also, the door flap assembly frame 320 nests into the spacers panels 945 above it and into the bottom fixed cross piece below it.

Figure 14:
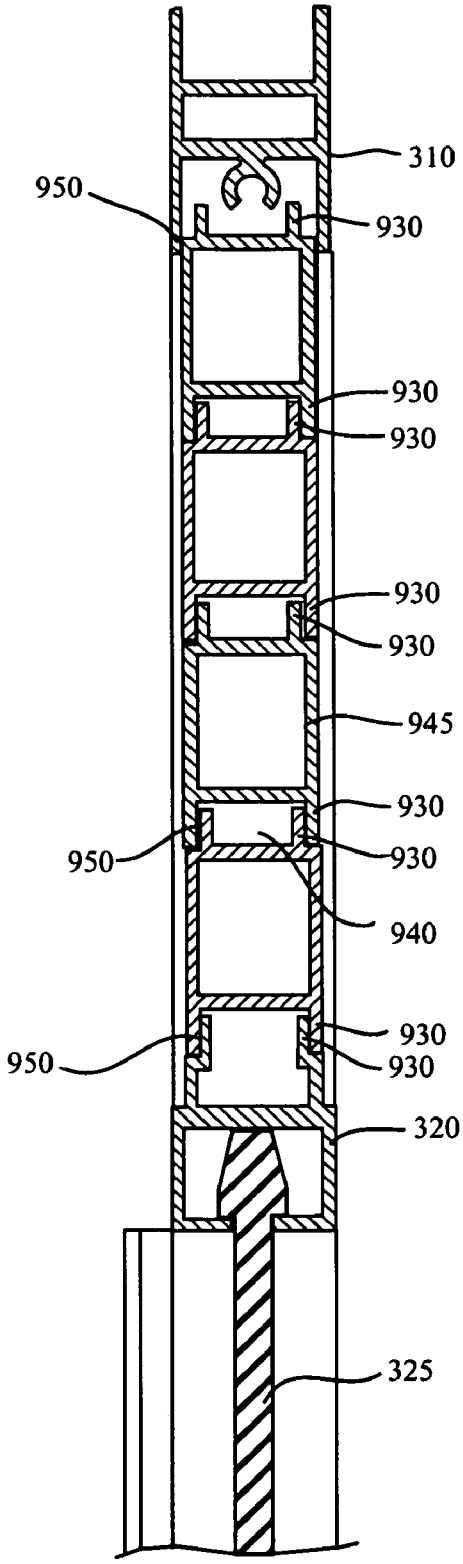
FIG. 14 is a close-up partial side cross sectional view of the panel pet door of FIG. 12.

Referring next to FIG. 14, shown is a close-up partial side cross sectional view of the panel pet door 300 of FIG. 12. Shown in FIG. 13 is the top fixed cross piece 310, nested movable spacer panels 945 and the top part of the movable entrance portal assembly 316 (showing the top of the door flap assembly frame 320 and flap 325). Shown in detail are the protrusions 930 on the top and bottom of the spacers 945 that nest together 950. Also note the clearance 940 between the spacer panels 945 for weather stripping, screws and other hardware.

Figure 15:
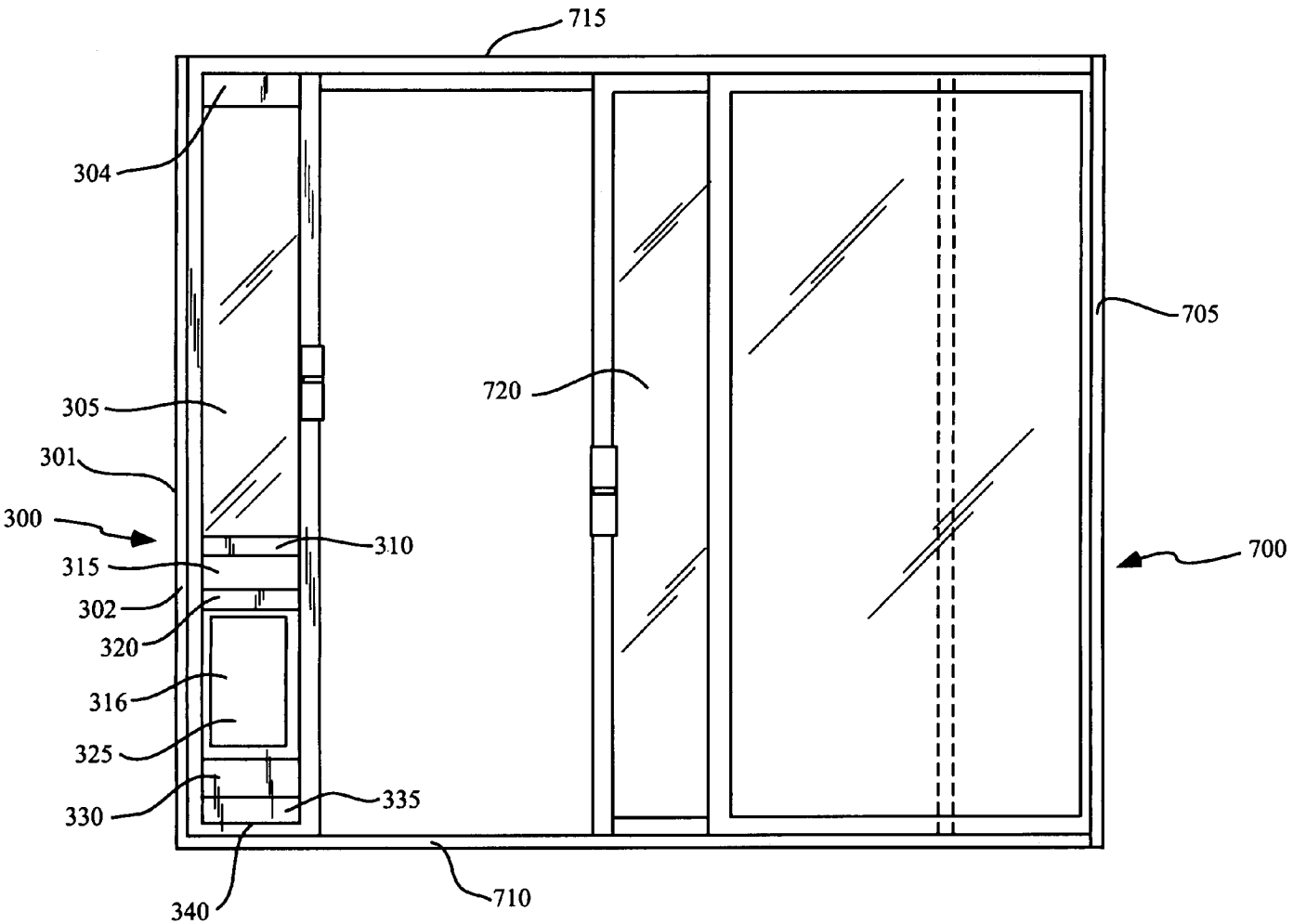
FIG. 15 is a front elevation view of the panel pet door of FIG. 3 installed in a sliding glass door frame.
Figure 16:
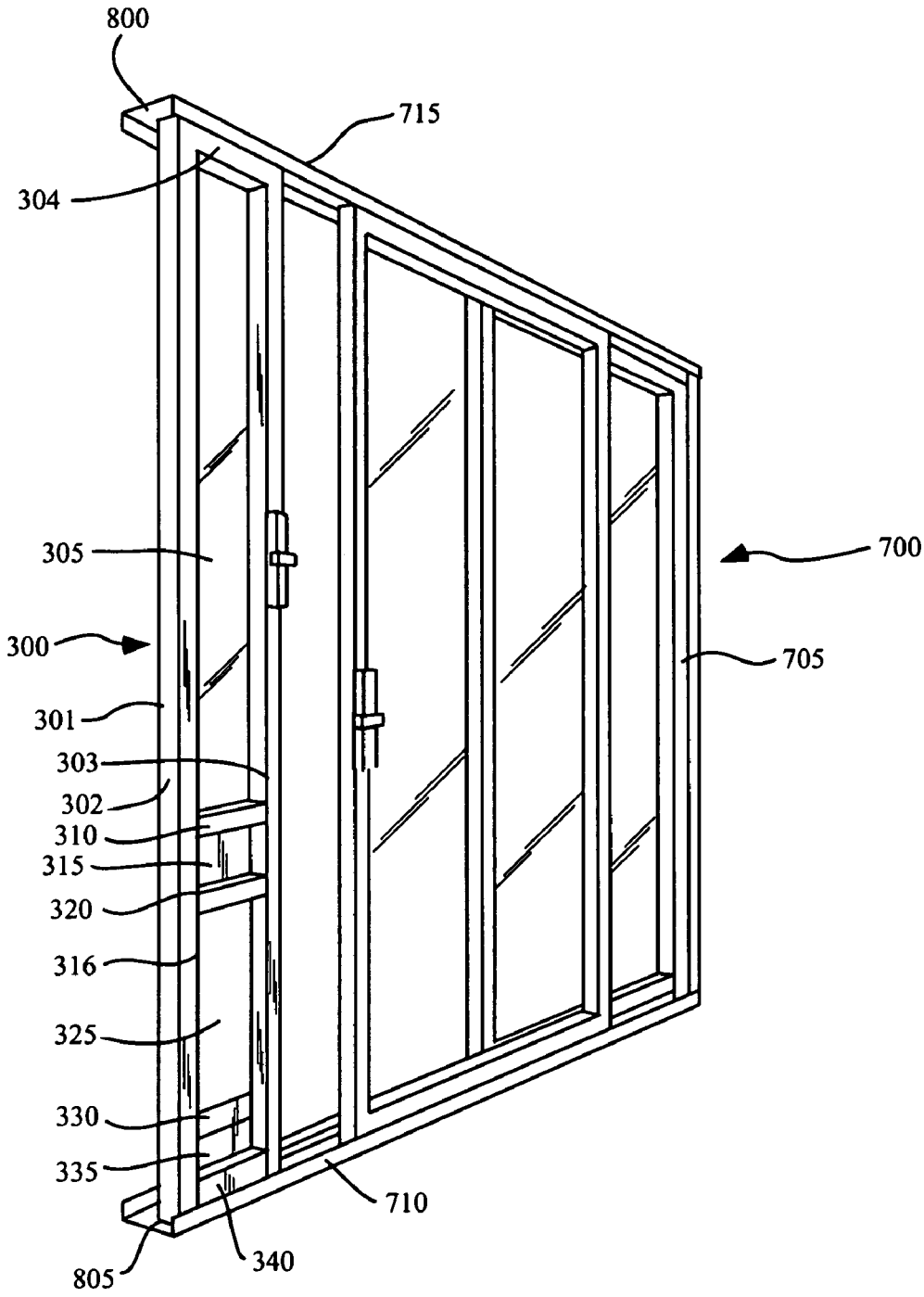
FIG. 16 is a front perspective view of the panel pet door of FIG. 15 installed in a sliding glass door frame.

Referring next to FIGS. 15 and 16, shown are front elevation and front perspective views, respectively, of the panel pet door 300 of FIG. 3 installed in a sliding glass door 700. Shown in FIGS. 15 and 16 are the panel door 300 and sliding glass door 700, a sliding glass door frame 705, a top horizontal frame member 715, a bottom horizontal frame member 710 and a glass door 720. Shown in FIG. 16 are horizontal tracks 800, 805 of the sliding glass door frame 705.

The panel pet door 300 fits as an insert into the frame 705 of the sliding glass door 700. The panel door frame 301 is of sufficient height to fit inside the sliding glass door frame 705 onto the respective tracks 800, 805 of the top and bottom frame members 715, 710, of the sliding glass door frame 705 (as shown in detail in FIG. 17).

Figure 17:
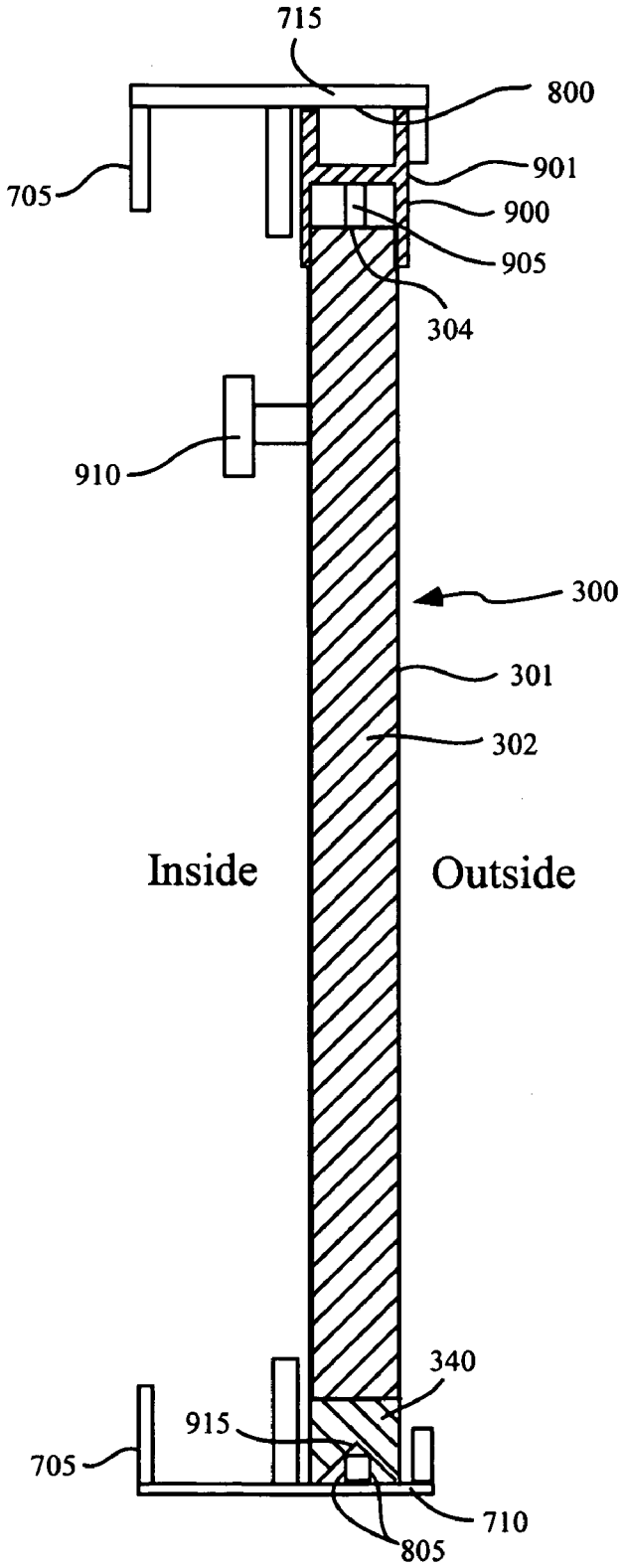
FIG. 17 is a side cross sectional view of the panel pet door in a sliding door of FIG. 16.

Referring next to FIG. 17, is a side cross sectional view of the panel pet door 300 in the sliding door 700 of FIG. 16. Shown is the vertical stile 302 and top and bottom cross pieces 304, 340 of the panel door frame 301 of the panel door 300. Also shown are the top and bottom tracks 800, 805 of the sliding glass door frame 705, a spring mechanism 900 having a spring 905 and a rail 901, and a thumb screw 910.

The spring mechanism 900 is located on the top of the top horizontal frame cross piece 304 of the panel door frame 301. The spring 905 supports the rail 901 which is inserted into top track 800 of the sliding glass door 700. The thumb screw is located on the interior side of the panel door frame 301 and is operably connected to the spring mechanism such that the spring mechanism is locked in place when the thumb screw is tightened and unlocked when loosened. The bottom cross piece 340 of the panel door frame 301 has a horizontal channel 915 that allows the bottom cross piece 340 to fit into the bottom outside track 805 of the sliding glass door frame 705.

The panel pet door frame 301 is inserted into the sliding glass door frame 705 by first loosening the thumb screw 910, then inserting the spring mechanism 900 into the top track 800. Then, while pushing up against the spring mechanism 900, the bottom of the panel door frame 301 is swung onto the bottom rail 805. The thumb screw 910 is then tightened to lock the spring mechanism 900 and thus the panel door frame 301 in place.

While the invention herein disclosed has been described by means of specific embodiments and applications thereof, numerous modifications and variations could be made thereto by those skilled in the art without departing from the scope of the invention set forth in the claims.

What is claimed is:

1. An adjustable panel door, comprising:

a panel door frame having a top cross piece and a bottom cross piece;

a portal assembly positioned between said top cross piece and said bottom piece, wherein the portal assembly comprises two vertical frame members, a top frame member and a bottom frame member; and an adjustable rise wherein at least one spacer panel is removably positioned adjacent to said portal assembly for adjusting said rise, wherein the rise is adjustable by adjusting a distance between the top cross piece and the bottom frame member of the portal assembly by adding or removing the at least one spacer panel.

2. The adjustable panel door of claim 1 wherein said at least one spacer panel is positioned above said portal assembly.

3. The adjustable panel door of claim 1 wherein said at least one spacer panel is positioned between said bottom cross piece and said portal assembly.

4. The adjustable panel door of claim 1 wherein said at least one spacer panel further comprises protrusions for nesting.

5. The adjustable panel door of claim 1 wherein said portal assembly further comprises a door flap.

6. The door flap of claim 5 wherein said door flap is flexible and coupled to said portal assembly.

7. An adjustable panel door comprising:

a panel door frame having a top cross piece and a bottom cross piece;

a portal assembly positioned between said top cross piece and said bottom piece, wherein the portal assembly comprises two vertical frame members, a top frame member and a bottom frame member; and an adjustable rise wherein a plurality of spacer panels are removably positioned adjacent to said portal assembly for adjusting the rise, wherein the rise is adjustable by adjusting a distance between the top cross piece and the bottom frame member of the portal assembly by adding or removing at least one of the spacer panels.

8. The adjustable panel door of claim 7 wherein said plurality of spacer panels further comprises protrusions for nesting.

9. An adjustable panel door comprising:

a panel door frame having a top cross piece and a bottom cross piece, a portal assembly having a width, a height, and an adjustable rise, wherein the portal assembly comprises two vertical frame members, a top frame member and a bottom frame member, wherein the rise is adjustable by adjusting a distance between the top cross piece and the bottom frame member of the portal assembly; and a plurality of spacer panels wherein said spacer panels are removably located adjacent to said portal assembly for adjusting the rise by adding or removing at least one of the spacer panels.

10. The adjustable panel door of claim 9 wherein said spacer panels are located above said assembly.

11. The adjustable panel door of claim 9 wherein said spacer panels are located below said portal assembly.

12. The adjustable panel door of claim 9 wherein said portal assembly further comprises a flap.

13. The adjustable panel door of claim 12 wherein the rise of said flap is adjustable by removing at least one spacer panel of said plurality of spacer panels from below said portal assembly.

14. The adjustable panel door of claim 12 wherein the rise of said flap is adjustable by adding at least one spacer panel of said plurality of spacer panels below said portal assembly.

15. The adjustable panel door of claim 9 wherein said plurality of spacer panels further comprise protrusions for nesting.

16. The door flap of claim 12 wherein said door flap is flexible and coupled to said portal assembly.

17. A method of assembling a panel door having a frame, a portal assembly, a plurality of spacer panels, and a rise, comprising:

a) arranging said plurality of spacer panels adjacent to said portal assembly, wherein the portal assembly comprises two vertical frame members, a top frame member and a bottom frame member; and b) inserting at least one of said spacer panels and said portal assembly into said frame, wherein said spacer panels are for adjusting the rise, wherein said frame comprises a top cross piece and a bottom cross piece, wherein the rise is adjustable by adjusting a distance between the top cross piece and the bottom frame member of the portal assembly by adding or removing at least one of the spacer panels.

18. The method of claim 17 further comprising the step of fixing a bottom cross piece below said arrangement of said plurality of spacer panels and said portal assembly.

19. The method of claim 17 further comprising the step of arranging said plurality of spacer panels and said portal assembly such that a desired rise is achieved.

20. The method of claim 17 further comprising the step of nesting said plurality of spacer panels.

21. The method of claim 17 further comprising the step of coupling a door flap to said portal assembly.

* * * * *